US005385451A

United States Patent [19]

Fujii et al.

[11] Patent Number: 5,385,451

[45] Date of Patent: Jan. 31, 1995

[54] SWASH-PLATE TYPE COMPRESSOR WITH TAPERED BEARINGS AND ROTARY VALVES

[75] Inventors: Toshiro Fujii; Koichi Ito; Kazuaki Iwama, all of Kariya, Japan

[73] Assignee: Kabushiki Kaisha Toyoda Jidoshikki Seisakusho, Aichi, Japan

[21] Appl. No.: 255,830

[22] Filed: Jun. 8, 1994

Related U.S. Application Data

[63] Continuation of Ser. No. 103,922, Aug. 6, 1992, abandoned.

[30] Foreign Application Priority Data

Aug. 6, 1992 [JP] Japan ..... 4-210542

[51] Int. Cl.[6] ..... F04B 1/12

[52] U.S. Cl. ..... 417/269; 92/71; 91/502

[58] Field of Search ..... 417/269; 92/71; 91/490, 91/499, 502

[56] References Cited

U.S. PATENT DOCUMENTS

| | | | |
|---|---|---|---|
| 1,367,914 | 2/1921 | Larsson . | |
| 1,925,378 | 9/1933 | Ferris et al. | 91/484 |
| 5,076,764 | 12/1991 | Kawai et al. . | |

FOREIGN PATENT DOCUMENTS

| | | | |
|---|---|---|---|
| 0513871 | 11/1992 | European Pat. Off. | 417/269 |
| 4041980 | 2/1992 | Japan | 417/269 |
| 0081469 | 4/1956 | Netherlands | 417/269 |
| 350135 | 3/1922 | Sweden . | |
| 1596126 | 9/1990 | U.S.S.R. | 417/269 |

*Primary Examiner*—Richard A. Bertsch
*Assistant Examiner*—M. Kocharov
*Attorney, Agent, or Firm*—Burgess, Ryan and Wayne

[57] ABSTRACT

A swash-plate type compressor comprising a cylinder block, front and rear valve plates, and front and rear housings attached to either end of the cylinder block over the valve plates. A swash-plate is accommodated in the cylinder block to reciprocally move a plurality of double headed pistons which form compression chambers on either side thereof. A drive shaft carries the swash-plate and is supported by a pair of tapered roller bearings. Each of the tapered roller bearings is secured in the central hole of each valve plate. Also, each valve plate is coupled to the cylinder block in a locating projection-locating hole fitting relationship to effect centering the drive shaft relative to the cylinder block. In addition, a suction passage is arranged to introduce the refrigerating gas from the swash-plate chamber to each of the compression chambers in such a manner as to reduce the radius of the cylinder block.

12 Claims, 8 Drawing Sheets

SWASH-PLATE TYPE COMPRESSOR WITH TAPERED BEARINGS AND ROTARY VALVES

This application is a continuation of application Ser. No. 08/103,992, filed Aug. 6, 1992 now abandoned.

BACKGROUND OF THE INVENTION

1. Field of the Invention

The present invention relates to a swash-plate type compressor including a swash-plate accommodated in a swash-plate chamber in a cylinder block and a plurality of reciprocally movable double-headed pistons inserted in the respective working bores in the cylinder block for forming compression chambers on either side of each of the double-headed pistons, and in particular, the present invention relates to an improved shaft-bearing structure in a swash-plate type compressor.

2. Description of the Related Art

Japanese Unexamined Patent Publication (Kokai) No. 3-92587, for example, discloses a swash-plate type compressor comprising a cylinder block, a drive shaft supporting a swash-plate and a plurality of double headed pistons arranged in the cylinder block. The cylinder block is formed of a front block half and a rear block half coupled together, and has at the juncture of the front and rear block halves a swash-plate chamber accommodating the swash-plate. The ends of the front and rear block halves are covered by front and rear housings, respectively, via valve plates.

A refrigerating gas to be compressed and containing lubricating oil therein is introduced from the outside conduit to the swash-plate chamber, and from the swash-plate chamber to the compression chambers, via suction passages. The suction passages are formed in the cylinder block between two adjacent working bores. A suction chamber is formed in the central region of the internal space between each of the front and rear housings and each of the valve plates, and a discharge chamber is formed in the peripheral region of the internal space between each of the front and rear housings and each of the valve plates. The suction chamber communicates with the compression chambers via suction valves and the discharge chamber communicates with the compression chambers via discharge valves. The refrigerating gas is introduced from the suction chamber to the compression chambers and discharged from the compression chambers into the discharge chamber, as the pistons reciprocally move.

In the swash-plate type compressor, the working bores are equidistantly arranged on a circle having a center in coincidence with the longitudinal center line of the compressor. The distance between two adjacent working bores is proportional to the radius of the working bore arranging circle; the greater the distance between two adjacent working bores is, the greater the radius of the working bore arranging circle, and the smaller the distance between two adjacent working bores is, the smaller the radius of the working bore arranging circle.

Usually, the distance between two adjacent working bores is sufficiently extended so that the strength of the cylinder block is ensured. The suction passages are formed in the cylinder block between two adjacent working bores, this suction structure causing a decrease in the structure of the cylinder block. Therefore, it is difficult to minimize the radius of the working bore arranging circle and to obtain a compactly designed compressor. Also, the arrangement of the suction passages in the cylinder block causes a reduction in the pressure of the refrigerating gas and the compression ratio decreases.

The drive shaft supporting the swash-plate is supported by a pair of radial bearings and a pair of thrust bearings. That is, the radial load to the drive shaft is supported by the cylinder block via the radial bearings, and the thrust load to the drive shaft is supported by the cylinder block via the thrust bearings. These bearings are lubricated by lubricating oil contained in the refrigerating gas. However, this arrangement in which the radial load and the thrust load are supported by separate bearings needs complex assembly work.

SUMMARY OF THE INVENTION

The object of the present invention is to provide a swash-plate type compressor in which the radial load and the thrust load to a driving shaft are supported by common bearings and simultaneously the driving shaft can be exactly centered relative to the cylinder block.

Another object of the present invention is to provide a swash-plate type compressor by which volumetric efficiency can be improved and a compact design of the compressor can be realized.

According to the present invention, there is provided a swash-plate type compressor comprising a cylinder block having opposite ends, a central bore, a plurality of working bores extending parallel to each other around the central bore, and a swash-plate chamber intersecting the central bore and the working bores, a gas to be compressed being introduced in the swash-plate chamber, first and second valve plates attached to either end of the cylinder block, each of the valve plates having a central hole and discharge valves arranged around the central hole in correspondence with the working bores, first and second housings attached to either end of the cylinder block over the valve plates to form discharge chambers between the housings and the valve plates, respectively, a drive shaft inserted in the central axial bore of the cylinder block, first and second tapered roller bearings secured in the central holes of the valve plates, respectively, to support the drive shaft, annular locating projection means arranged on one of the cylinder block and the valve plates around the drive shaft, locating hole means arranged in the other of the cylinder block and the valve plates to fit over the annular locating projection means, a swash-plate accommodated in the swash-plate chamber and fixed to the drive shaft for rotation therewith, a plurality of double headed pistons inserted in the respective working bores and reciprocally moved by the swash-plate for forming compression chambers on either side of each of the double headed pistons, the compression chambers on one side of the double-headed pistons being communicable with one of the discharge chambers via the discharge valves, and a suction passage extending from the swash-plate chamber to each of the compression chambers between the first and second valve plates.

With this arrangement, both the radial load and the thrust load acting on the driving shaft are supported by a pair of tapered roller bearings, which are supported in the respective valve plates. The valve plates are supported by the cylinder block via the fitted annular locating projection-hole means which are coaxially arranged with the center of a working bore arranging circle. Accordingly, the tapered roller bearings have an axis in coincidence with the center of the working-bore-arranging circle, and the rotation center of the drive shaft supported by the valve plates coincides with the center of the working-bore-arranging circle.

Also, it is not necessary to arrange the suction passage in the cylinder block between two adjacent compression chambers, but the suction passage can be arranged, for example, on the radially inside of each of the compression chambers. It is, therefore, possible to reduce the radius of the working bore arranging circle and to obtain a compactly designed compressor.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
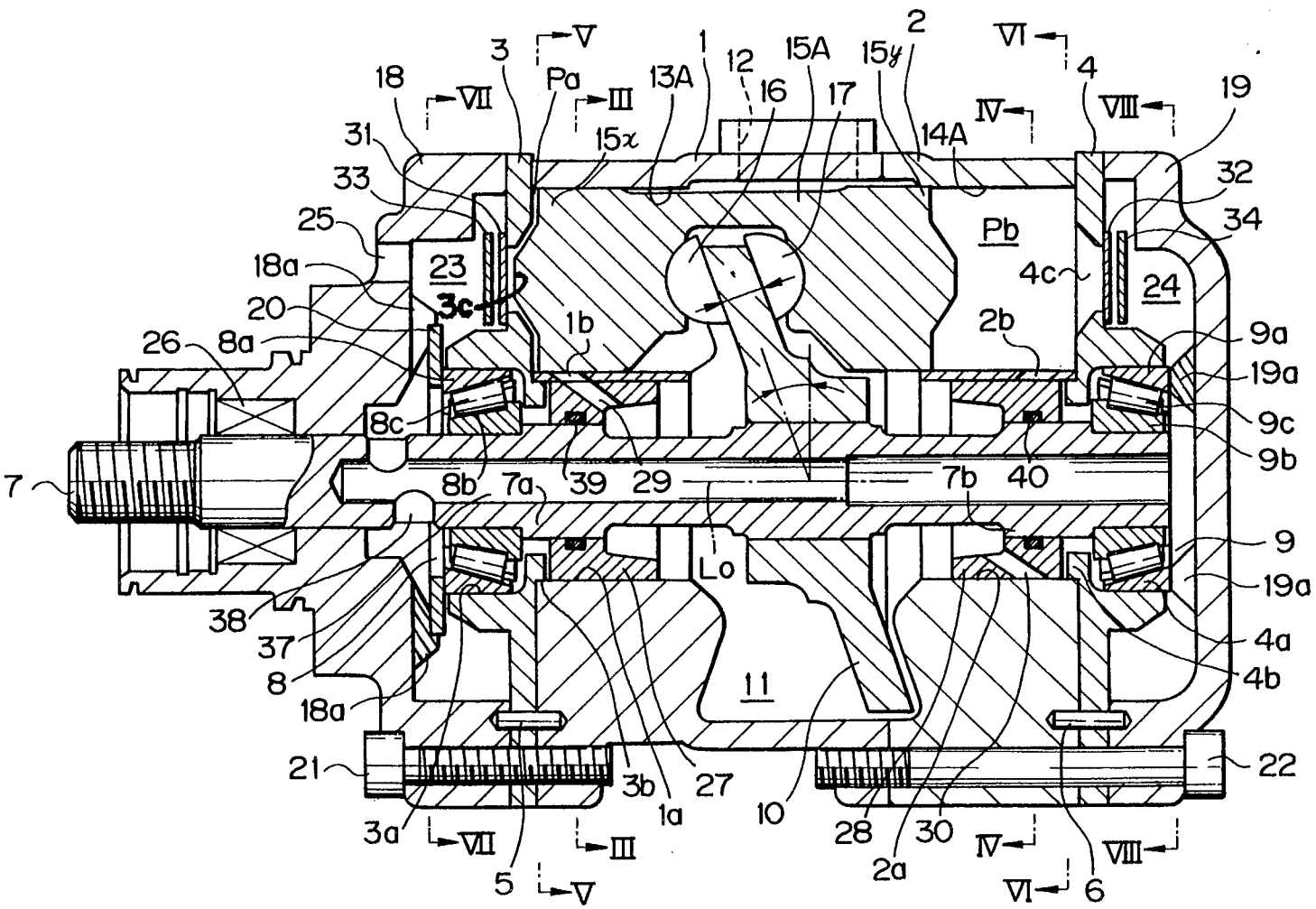
FIG. 1 is a cross-sectional view of a swash-plate type compressor according to the first embodiment of the present invention.
Figure 2:
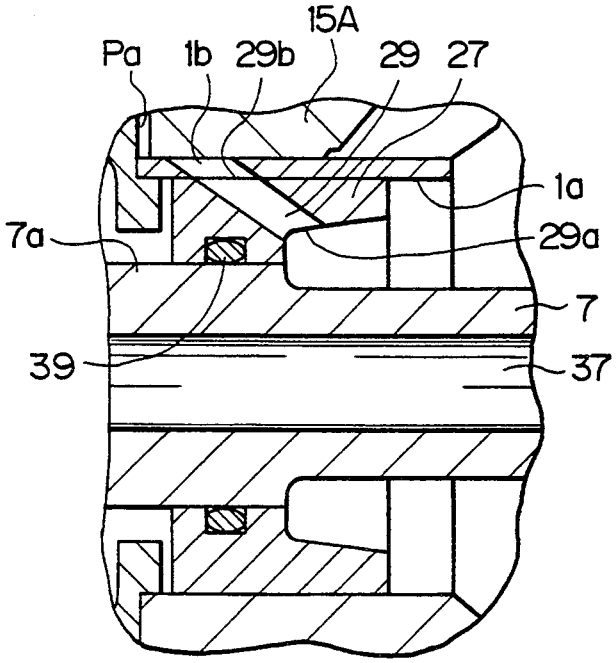
FIG. 2 is an enlarged partial cross-sectional view of the suction port and the rotary valve of the compressor of FIG. 1.

FIG. 1 shows a swash-plate type compressor according to the first embodiment of the present invention. The compressor comprises a cylinder block constituted by a front block half 1 and a rear block half 2 coupled together. The cylinder blocks 1 and 2 have opposite ends to which front and rear valve plates 3 and 4 are attached, respectively, and a front housing 18 and a rear housing 19 are attached to the cylinder block over the respective valve plates 3 and 4.

The front block half 1 has a central bore 1*a* and the rear block half 2 has a central bore 2*a*, the central bores 1*a* and 2*a* forming a central bore of the cylinder block. The cylinder block has a swash-plate chamber 11 at the juncture of the front and rear block halves 1 and 2, and a suction inlet 12 for receiving a refrigerating gas from a refrigerating conduit (not shown). The suction inlet 12 communicates with the swash-plate chamber 11 and the refrigerating gas is introduced from the suction inlet 12 into the swash-plate chamber 11.

The front and rear block halves 1 and 2 also have a plurality of working bores 13 (and 13A) and 14 (and 14A) extending in pairs in line, with the pairs of the working bores 13 and 14 extending parallel to each other around the central axial bores 1*a* and 2*a* at circumferentially equidistant pitches. Note, one of the working bores 13 located at the top in the drawings is represented by the reference character 13A and one of the working bores 14 located at the top in the drawings is represented by the reference character 14A, as shown in FIGS. 3 to 8. The swash-plate chamber 11 intersects the central bores 1*a* and 2*a* and the working bores 13 (and 13A) and 14 (and 14A).

A pin 5 extends from the front housing 18 through the front valve plate 3 to the front block half 1 to bring these elements into an axial alignment, and a pin 6 extends from the rear housing 19 through the rear valve plate 4 to the rear block half 2 to bring these elements into an axial alignment. Also, fastening bolts 21 extend through the front housing 18, the front valve plate 3, and the front block half 1 to fasten these elements together, and fastening bolts 22 extend through the rear housing 19, the rear valve plate 4, the rear block half 2, and the front block half 1 to fasten these elements together.

A swash-plate 10 is accommodated in the swash-plate chamber 11. A hollow drive shaft 7 is inserted in the central bore 1*a* and 2*a* of the cylinder block 1 and 2 to fixedly support the swash-plate 10.

A plurality of double headed pistons 15 (and 15*a*) are inserted in the respective pairs of working bores 1*a* and 2*a* for forming compression chambers Pa and Pb in each of the working bores 13 (and 13A) and 14 (and 14A) on either side of each of the double headed pistons 15. Note, one of the pistons 15 located at the top in the drawings is represented by the reference character 15A, as shown in FIGS. 3 to 8. One end of the pistons 15 (and 15*a*) is represented by the reference character 15*x* and the other end of the pistons 15 (and 15*a*) is represented by the reference character 15*y*. Each of the pistons 15 (and 15*a*) is engaged with the swash-plate 10 via shoes 16 and 17 so that each of the pistons 15 is reciprocally moved in the respective working bores by the rotating swash-plate 10.

A discharge chamber 23 is formed in the internal space between the front housing 18 and the front valve plate 3, and a discharge chamber 24 is formed in the internal space between the rear housing 19 and the rear valve plate 4.

Figure 7:
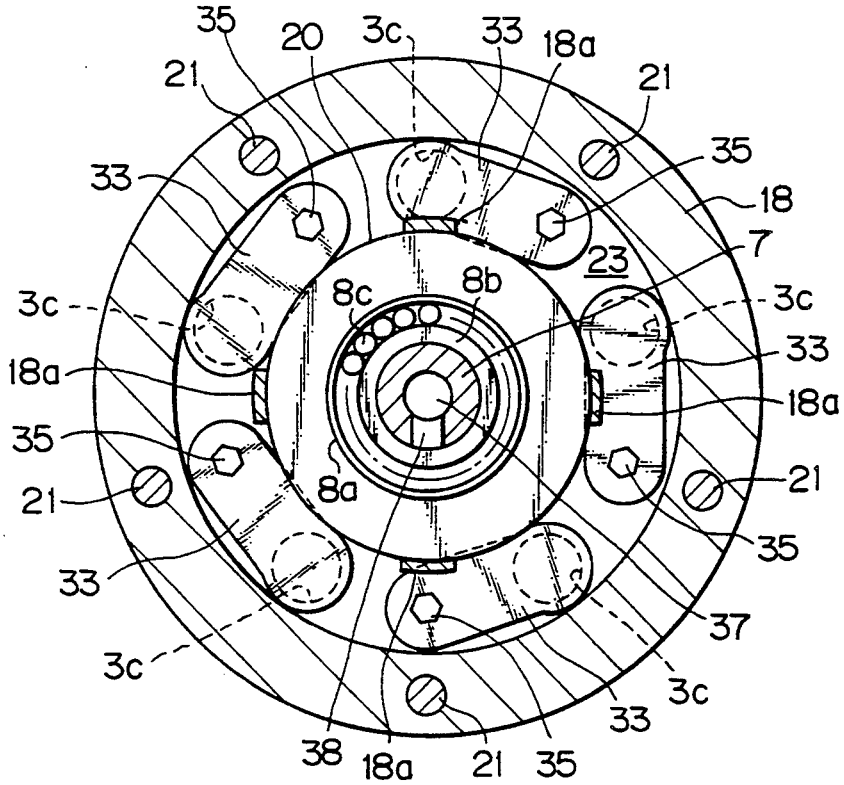
FIG. 7 is a cross-sectional view of the compressor of FIG. 1, taken along the line VII—VII in FIG. 1.
Figure 8:
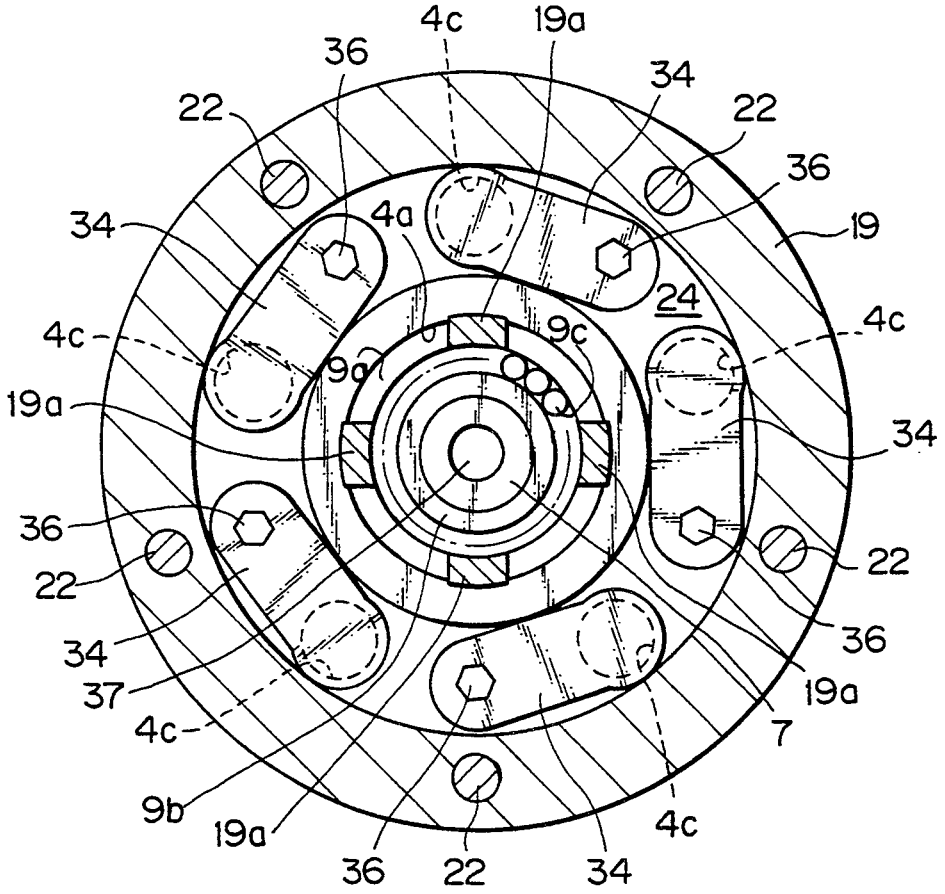
FIG. 8 is a cross-sectional view of the compressor of FIG. 1, taken along the line VIII—VIII in FIG. 1.

The valve plates 3 and 4 have central boss portions having central holes 3*a* and 4*a*, and discharge ports 3*c* and 4*c* arranged around the central holes 3*a* and 4*a* in correspondence with the working bores 13 (and 13A) and 14 (and 14A), respectively. Flapper type discharge valves 31 and 32 are arranged in the discharge ports 3*c* and 4*c*, respectively, to allow the refrigerating gas to flow in one direction from the compression chamber Pa or Pb to the discharge chamber 23 or 24. A retainer 33 or 34 is provided to prevent an excess lift of the discharge valve 31 or 32. The discharge valves 31 and 32 and the retainers 33 and 34 are held by bolts 35, and 36 as shown in FIGS. 7 and 8.

In addition, the valve plates 3 and 4 have annular or cylindrical locating projections 3*b* and 4*b* around the drive shaft 7. The locating projections 3*b* and 4*b* are arranged in a back-to-back relationship to the boss portions having the central holes 3*a* and 4*a* and extend axially inwardly from the boss portions, respectively. Each of the central bores 1*a* of the front block half 1 and the central bores 2*a* of the rear block half 2 has an inner diameter greater than the outer diameter of the drive shaft 7 and identical to the outer diameter of the locating projections 3b and 4b so that the locating projections 3b and 4b can be fit in the central bores 1a and 2a of the front and rear block halves 1 and 2. Accordingly, end portions of the central bores 1a and 2a of the front and rear block halves 1 and 2 constitute locating holes to fit over the locating projections 3b and 4b, respectively.

Tapered roller bearings 8 and 9 are arranged in the central holes 3a and 4a of the valve plates 3 and 4, respectively, to support the drive shaft 7. The tapered roller bearing 8 comprises an outer ring 8a, an inner ring 8b, and a plurality of rollers 8c arranged between the outer and inner rings 8a and 8b in a cone. Similarly, the tapered roller bearing 9 comprises an outer ring 9a, an inner ring 9b, and a plurality of rollers 9c arranged between the outer and inner rings 9a and 9b in a cone.

The drive shaft 7 has large diameter portions 7a and 7b to form shoulders, and the inner rings 8b and 9b of the tapered roller bearings 8 and 9 are axially received by the shoulders of the drive shaft 7, respectively. Projections 18a and 19a are provided at the base of the front and rear housings 18 and 19 to axially receive the outer rings 8a and 9a of the tapered roller bearings 8 and 9, respectively. In the embodiment, a dish-shaped spring 20 is inserted between the projection 18a and the outer ring 8a and 9a of the tapered roller bearing 8.

The tapered roller bearings 8 and 9 support both the radial load and the thrust load to the drive shaft 7. The fastening force of the bolt 21 causes the spring 20 to be deformed to provide a prestress in the thrust direction to the drive shaft 7 via the tapered roller bearing 81.

Figure 5:
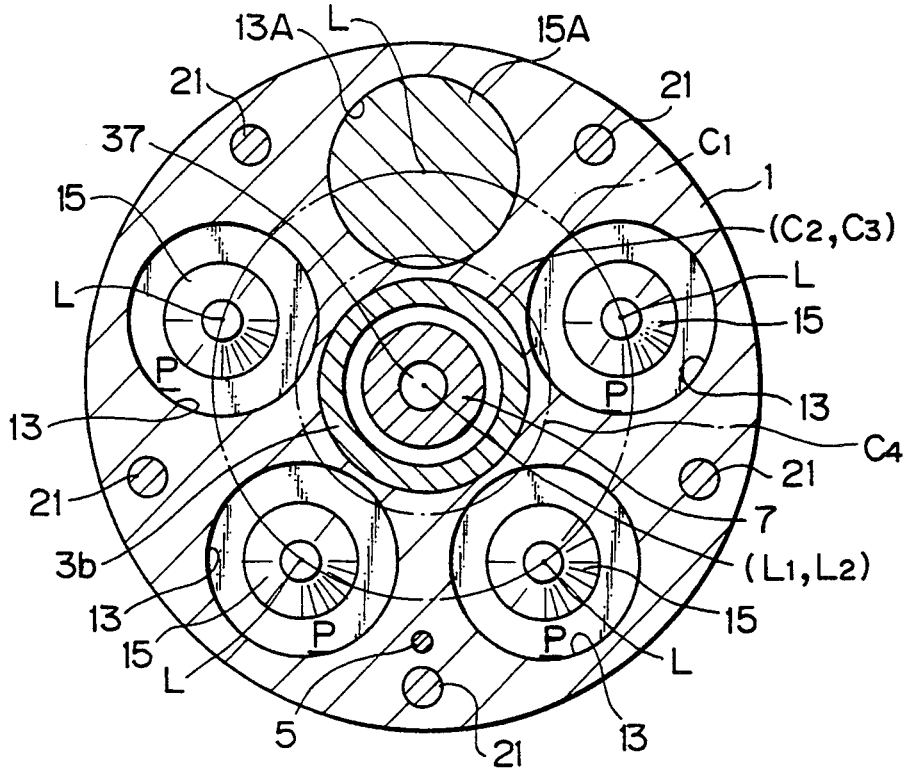
FIG. 5 is a cross-sectional view of the compressor of FIG. 1, taken along the line V—V in FIG. 1.
Figure 6:
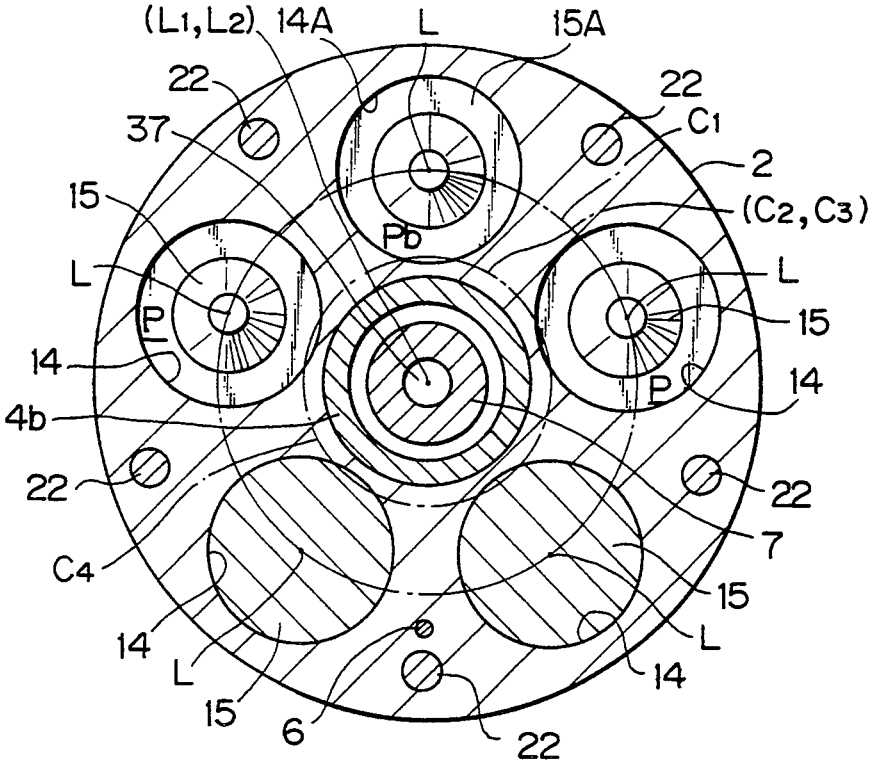
FIG. 6 is a cross-sectional view of the compressor of FIG. 1, taken along the line VI—VI in FIG. 1.

In FIG. 1, the central axis $L_0$ of the drive shaft 7 is shown. In FIGS. 5 and 6, the central axes L of the working bores 13, 13A, 14 and 14A are arranged on the working bore arranging circle $C_1$ having the center $L_1$. The center $L_2$ of the circle $C_2$ of the inner cylindrical surface of the central bores 1a and 2a coincides with the center $L_1$ of the working bore arranging circle $C_1$ because the working bores 13, 13A, 14 and 14A and the central bores 1a and 2a are formed in the common cylinder block. The circle $C_3$ of the outer cylindrical surface of the locating projections 3b and 4b which fit in the central holes (locating holes) 1a and 2a and the circle $C_4$ of the inner cylindrical surface of the central holes 3a and 4a have the same center $L_3$ because of the fitting relationship. Accordingly, the center $L_3$ of the locating projections 3b and 4b lies on the center $L_1$ of the working bore arranging circle $C_1$, and so the central axis of the tapered roller bearings 8 and 9 supported by the valve plates 3 and 4 lies on the center $L_1$. The central axis of the tapered roller bearings 8 and 9 coincides with the central axis $L_0$ of the drive shaft 7, and the central axis $L_0$ of the drive shaft 7 lies on the center $L_1$ of the working bore arranging circle $C_1$, although the drive shaft 7 is not directly supported by the cylinder block.

The hollow drive shaft 7 includes a discharge passage 37 and radial holes 38 to interconnect the front and rear discharge chambers 23 and 24. The front housing 18 has a discharge outlet 25. The drive shaft 7 extends through the front housing 18 and a lip seal element 26 is provided to prevent a leak of the compressed gas in the discharge chamber 23 through the clearance between the drive shaft 7 and the front housing 18.

As shown in FIGS. 1 to 4, the cylinder block 1 and 2 has suction ports 1b and 2b arranged in correspondence with the working bores 13, 13A, 14, and 14a and extending radially from the inner surface of the central bores 1a and 2a to the inner surfaces of the working bores 13, 13A, 14 and 14A. The inner diameter of the central bores 1a and 2a of the cylinder block is greater than the outer diameter of the drive shaft 7, as previously described, and rotary valves 27 and 28 are arranged between the inner surface of the central bore 1a and 2a and the outer surface of the drive shaft 7. The rotary valves 27 and 28 are secured to the drive shaft 7 for rotation therewith to selectively open or close the suction ports 1b and 2b. O-ring seals 39 and 40 are arranged between the rotary valves 27 and 28 and the drive shaft 7, respectively.

Figure 3:
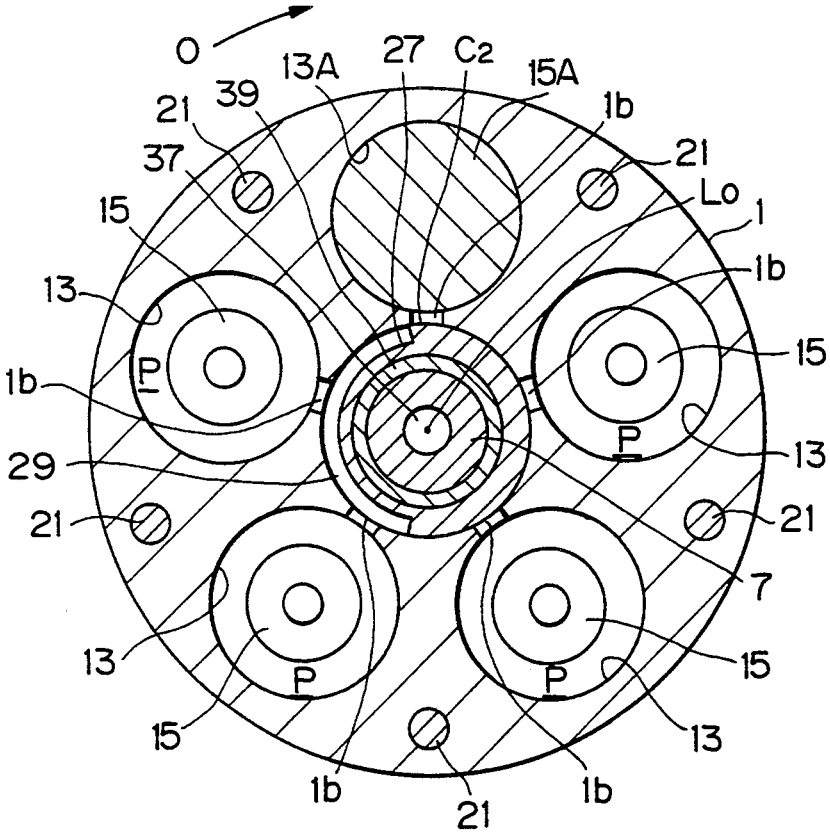
FIG. 3 is a cross-sectional view of the compressor of FIG. 1, taken along the line III—III in FIG. 1.
Figure 4:
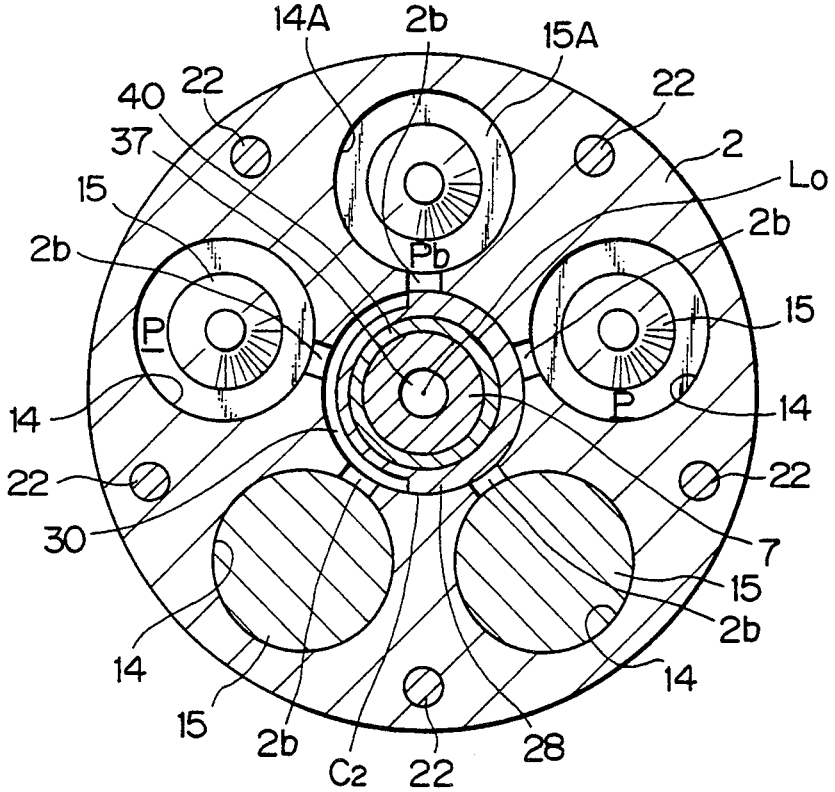
FIG. 4 is a cross-sectional view of the compressor of FIG. 1, taken along the line IV—IV in FIG. 1.

As shown in FIGS. 3 and 4, each of the rotary valves 27 and 28 has a generally cylindrical shape and comprises a cylindrical valve body having a valve port 29 (or 30). The valve port 29 or 30 obliquely extends through the valve body and has an inlet 29a communicating with the swash-plate chamber 11 and an outlet 29b selectively communicable with the suction ports 1b and 2b.

In operation, the refrigerating gas is introduced from the outside refrigerating conduit into the swash-plate chamber 11 via the suction inlet 12 and then from the swash-plate chamber 11 to compression chambers Pa and Pb via the suction ports 1b and 2b. The rotation of the drive shaft 7 is transferred to the pistons 15 and 15A via the swash-plate 10 and the pistons 15 and 15A move reciprocally in the working bores 13, 13A, 14, and 14A to effect the suction stroke and the compression stroke.

As shown in FIGS. 1, 3 and 4, regarding one of the pistons 15A, the piston 15A is at the top dead center with respect to the working bore 13A and at the bottom dead center with respect to the working bore 14A. When the piston 15A is in the suction stroke with respect to the working bore 13A wherein the piston 15A moves from the top dead center to the bottom dead center, the valve port 29 is communicated with the compression chamber Pa via the suction port 1b. The refrigerating gas is thus introduced from the swash-plate chamber 12 to compression chamber Pa via the valve port 29 and the suction port 1b. That is, the rotary valve 27 opens the suction passage between the swash-plate chamber 12 and the suction port 1b.

In this case, regarding the opposite compression chamber Pb, the piston 15A is in the compression and discharge stroke with respect to the working bore 14A wherein the piston 15A moves from the bottom dead center to the top dead center, the valve port 30 of the rotary valve 28 is prevented from the communication with the suction port 1b and the compression chamber Pb. The refrigerating gas in the compression chamber Pb is thus compressed by the piston 15A, and discharged into the discharge chamber 24 with the discharge valve 32 opened by the pressure of the refrigerating gas.

When the piston 15A is moved in the reverse direction, the piston 15A is in the suction stroke with respect to the compression chamber Pb and in the compression and discharge stroke with respect to the compression chamber Pa. The refrigerating gas is thus sucked from the swash-plate chamber 11 into the compression chamber Pb and discharged from the compression chamber Pa into the discharge chamber 23. This operation is repeatedly carried out with respect to the piston 15A as well as the other pistons 15.

The use of the rotary valves 27 and 28 in the suction passages have the following advantages, compared with conventional flapper type suction valves. In the case of flapper type suction valves, the lubricating oil provides an adhering force by which the valve is apt to stick to its valve seat to some extent and the opening timing of the valve is delayed due to the lubricant adhering force. This delay increases a flow resistance of the refrigerating gas to open the elastic valve and to flow therethrough and reduces the volumetric efficiency. However, according to the present invention using the rotary valves 27 and 28 which are mechanically driven, the problem of the flow resistance due to the lubricant adhering force and the elastic valve does not exist and the refrigerating gas flows immediately when the pressure in the compression chambers Pa and Pb is slightly lower than the pressure in the suction passage in the swash-plate chamber 11. Accordingly, it is possible to increase the volumetric efficiency by using the rotary valves 27 and 28, compared with conventional flapper type suction valves.

As described above, in the conventional compressor, each suction passage is proved between two adjacent working bores and such an arrangement reduces the strength of the cylinder block. Also, the discharge passage is provided in the cylinder block. Therefore, the distance between two adjacent working bores is sufficiently extended so that the strength of the cylinder block is ensured. Therefore, it is difficult to minimize the distance between the adjacent working bores.

According to the present invention, the provision of the rotary valves 27 and 28 having valve ports 29 and 30 to introduce the refrigerating gas into the compression chambers Pa and Pb solves the problem of the conventional suction passages which are provided in the cylinder block between two adjacent working bores. It is possible to reduce the distance between the adjacent working bores 13, 13A, 14, and 14A, by avoiding such a conventional suction passage arrangement. The reduction of the distance between the adjacent working bores 13, 3A, 14, and 14A makes it possible to reduce the radius of the circle on which the working bores 13, 13A, 14, and 14A are arranged, and thus reduce the radius of the cylinder block. Accordingly, it is possible to reduce the size and weight of the compressor.

The refrigerating gas in the swash-plate chamber 11 flows into the compression chambers Pa and Pb when the pressure in the compression chambers Pa and Pb is slightly lower than the pressure in the swash-plate chamber 11. The pressure loss becomes greater and the compression efficiency decreases if the flow resistance, i.e., the suction resistance, in the suction passage extending from the swash-plate chamber 11 to the compression chambers Pa and Pb is greater. By using the rotary valves 27 and 28, it is possible to minimize the length of the suction passages from the swash-plate chamber 11 to the compression chambers Pa and Pb and thus to reduce the flow resistance, as compared with the prior art. Accordingly, the loss is reduced and the compression efficiency is increased.

The provision of the discharge passage 37 arranged in the hollow drive shaft 7 makes it unnecessary to use a space in the cylinder block and contributes to the compact design of the compressor.

In addition, by using the rotary valves 27 and 28, it is possible to cancel suction chambers in the prior art which are arranged in the front and rear housings 18 and 19. Therefore, according to the present invention, it is possible to arrange the tapered roller bearings 8 and 9 at positions between the front and rear valve plates 3 and 4 and the front and rear housings 18 and 19 where suction chambers in the prior art are arranged. Accordingly, by using the rotary valves 27 and 28, it is not necessary to prepare an additional space for the tapered roller bearings 8 and 9 and the compact design of the compressor can be established without any obstruction. In addition, the tapered roller bearings 8 and 9 can support both the radial load and the thrust load to the drive shaft 7 and it is possible to reduce the number of the bearings, as compared with the prior art. Accordingly, it is possible to facilitate the assembly work of the compressor.

In addition, if the central axis $L_0$ of the drive shaft 7 does not lie on the center $L_1$ of the working bore arranging circle $C_1$, a problem arises as follows. As shown in FIG. 1, supposing that the inclination of the swash-plate 10 is $\theta$ and the thickness of the swash-plate 10 is "T", a component "t" of the thickness T of the swash-plate 10 in the direction of the central axis $L_0$ is $t=T/\cos\theta$. Supposing that the central axis $L_0$ of the drive shaft 7 inclines relative to the center line $L_1$ by a minute angle $\Delta\theta$ ($\Delta\theta>0$), the inclination of the swash-plate 10 is $\Delta\theta$ relative to the initial inclination $\theta$. Thus, the inclination of the swash-plate 10 is $(\Delta\theta+\theta)$ or $(\Delta\theta-\theta)$. If the inclination of the swash-plate 10 is $(\Delta\theta+\theta)$, a component $t^+$ of the thickness T of the swash-plate 10 in the direction of the central axis $L_0$ is $t^+=T/(\Delta\theta+\theta)$, which is greater than $t=T/\cos\theta$. If the inclination of the swash-plate 10 is $(\Delta\theta-\theta)$, a component $t^-$ of the thickness T of the swash-plate 10 in the direction of the central axis $L_0$ is $t^-=T/(\Delta\theta-\theta)$, which is smaller than $t=T/\cos\theta$.

The component "t" of the thickness T of the swash-plate 10 in the direction of the central axis $L_0$ is predetermined so that an appropriate clearance exists between the swash-plate 10 and the shoes 16 and 17. If the component of the thickness T of the swash-plate 10 in the direction of the central axis $L_0$ becomes $t^+$ ($>t$), there is a possibility that it is impossible to insert the swash-plate 10 between the shoes 16 and 17. Inversely, if the component of the thickness T of the swash-plate 10 in the direction of the central axis $L^0$ becomes $t^-$ ($<t$), the clearance between the swash-plate 10 and the shoes 16 and 17 becomes excessively large, and noise and oscillation may occur.

If the central axis $L_0$ of the drive shaft 7 lies on the center $L_1$ of the working bore arranging circle $C_1$, the distances between the central axes L of the working bores 13, 13A, 14 and 14A and the axis $L_0$ are the same. Supposing that this distance (i.e., the radius of the working bore arranging circle $C_1$) is "r", the stroke of each piston 15 or 15A is $r/\tan\theta$. If the central axis $L_0$ of the drive shaft 7 is shifted relative to the center $L_1$ while maintaining the parallel relationship, the distances between the central axes L of the working bores 13, 13A, 14 and 14A and the axis $L_0$ are not the same. Supposing that the difference in the distances is $\Delta r(>0)$, the distances between the central axes L of the working bores 13, 13A, 14 and 14A and the axis $L_0$ are $(r+\Delta r)$ and $(r-\Delta r)$.

The stroke of each piston 15 or 15A is predetermined so that an appropriate top clearance exists between each of the ends 15*x* and 15*y* of each piston 15 or 15A and each of the valve plates 3 and 4 when the piston is in the top dead center. If the distance between the central axes L and the axis $L_0$ is $(r+\Delta r)$, the stroke of each piston 15 or 15A becomes $(r+\Delta r)/\tan\theta$, and the top clearance becomes smaller than an appropriate value. In the worst case, the top clearance may become a minus value and the piston 15 or 15A may interfere with the valve plates 3 and 4. If the distance between the central axes L and the axis $L_0$ is $(r-\Delta r)$, the stroke of each piston 15 or 15A becomes $(r-\Delta r)/\tan\theta$, and the top clearance becomes greater than an appropriate value. The greater the top clearance becomes, the lower the compression efficiency is.

In the present invention, the tapered roller bearings 8 and 9 supporting the drive shaft 7 are supported in the central holes 3*a* and 4*a* of the valve plates 3 and 4. Accordingly, the central axis $L_0$ of the drive shaft 7 lies on the center $L_1$ of the working bore arranging circle $C_1$, if the valve plates 3 and 4 are exactly located relative to the cylinder block 1 and 2. The valve plates 3 and 4 are supported by the cylinder block 1 and 2 with the annular locating projections 3*b* and 4*b* fitted in the central holes (locating holes) 1*a* and 2*a*. Therefore, if the center $L_2$ of the circle $C_2$ of the inner cylindrical surface of the central bores 1*a* and 2*a* coincides with the center $L_1$ of the working bore arranging circle $C_1$, the central axis $L_0$ of the drive shaft 7 lies on the center $L_1$ of the working bore arranging circle $C_1$. It is easy to place the center $L_2$ on the center $L_1$. Accordingly, it is possible to exactly place the central axis $L_0$ on the center $L_1$ and thus to prevent the occurrence of noise and oscillation and the reduction of the compression efficiency.

The pins 5 and 6 assist in determining the angular position of the valve plates 3 and 4 around the central axis $L_0$ of the drive shaft 7 relative to the cylinder block 1 and 2.

Figure 9:
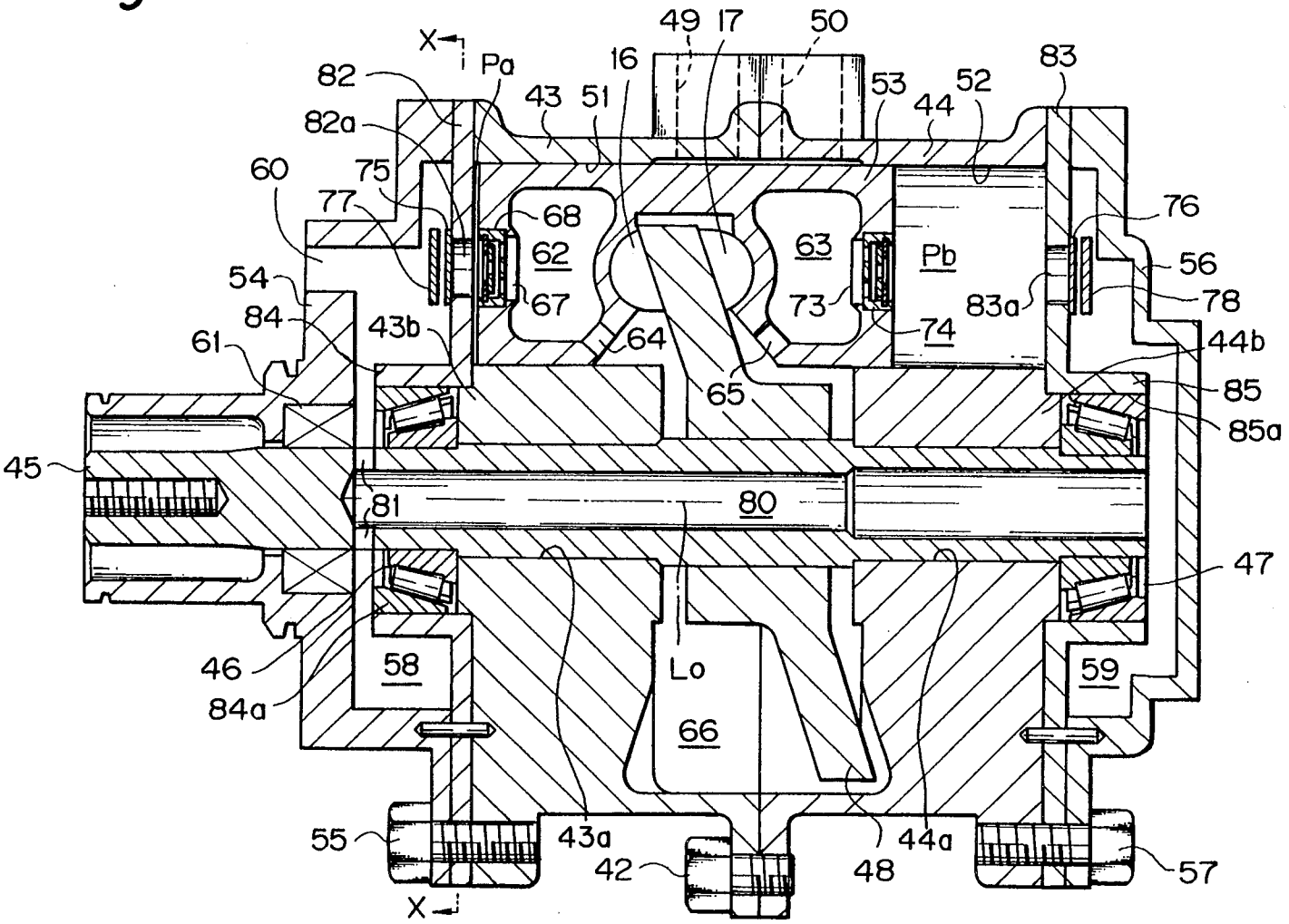
FIG. 9 is a cross-sectional view of a swash-plate type compressor according to the second embodiment of the present invention.
Figure 10:
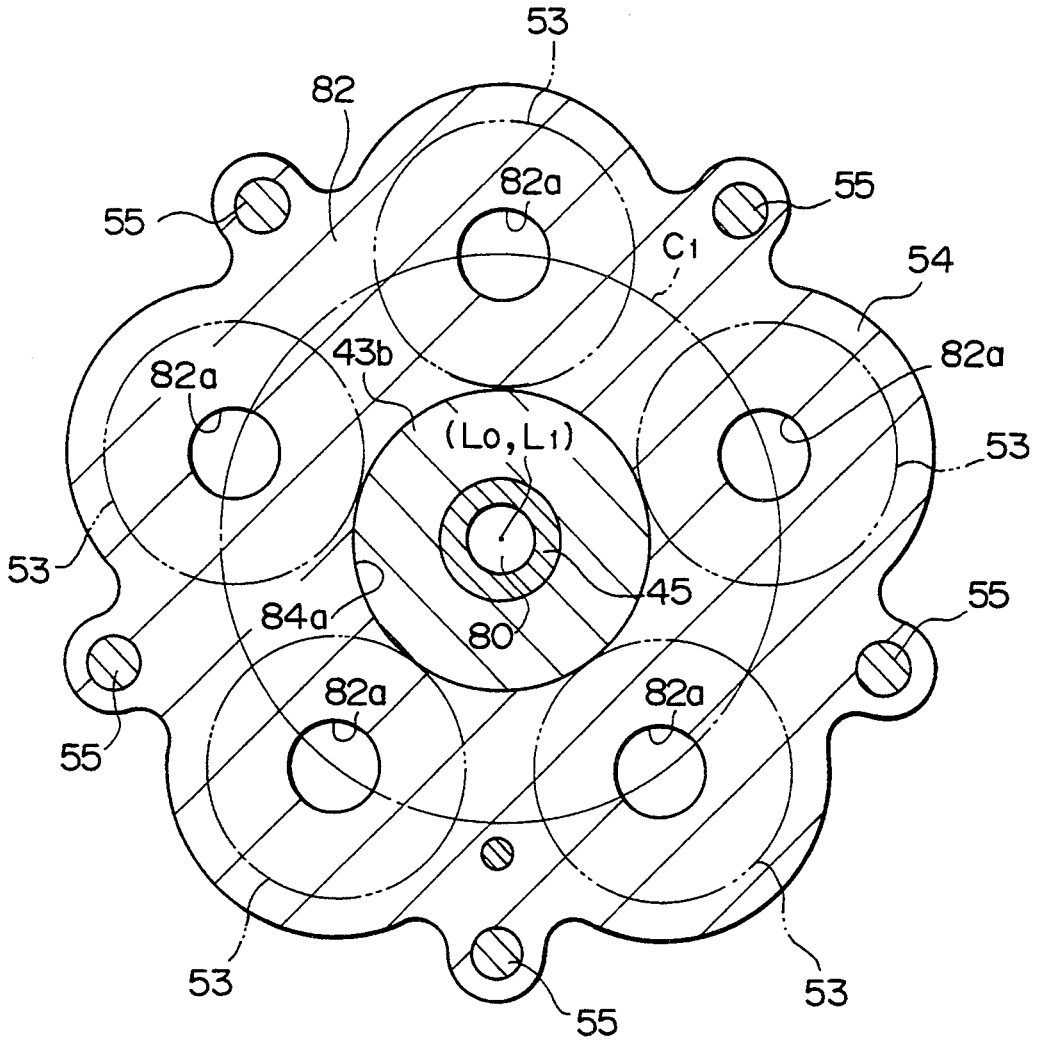
FIG. 10 is a cross-sectional view of the compressor of FIG. 9, taken along the line X—X in FIG. 9.
Figure 11:
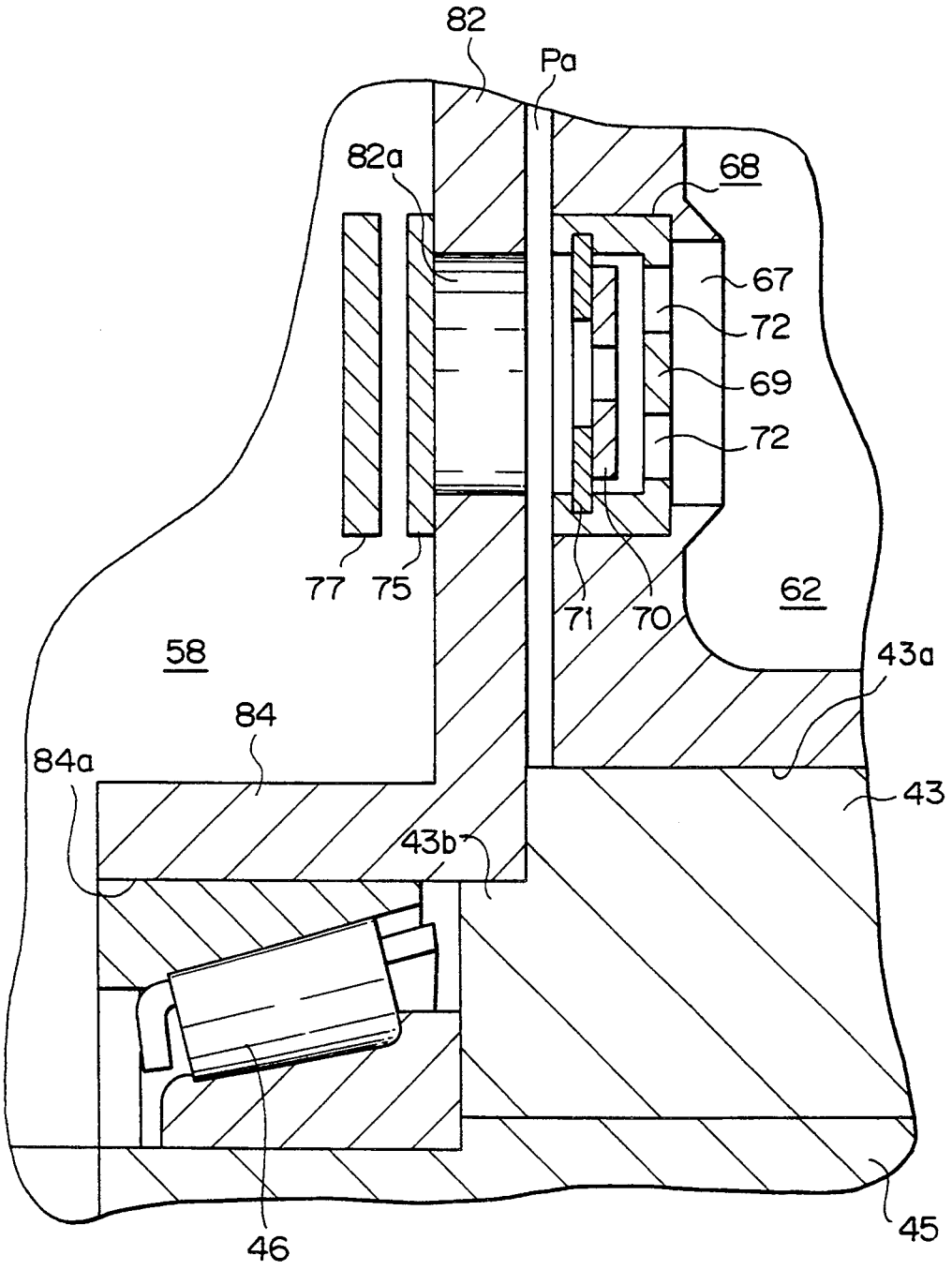
FIG. 11 is an enlarged partial cross-sectional view of the suction port and the tapered roller bearing of the compressor of FIG. 9.

FIGS. 9 to 11 show a swash-plate type compressor according to the second embodiment of the present invention. The compressor comprises a cylinder block constituted by a front block half 43 and a rear block half 44 coupled together by bolts 42. The cylinder blocks 43 and 44 have opposite ends to which front and rear valve plates 82 and 83 are attached, respectively, and a front housing 54 and a rear housing 56 are attached to the cylinder block over the respective valve plates 82 and 83. Bolts 55 extend through the front housing 54, the front valve plate 82 and the front block half 43, and bolts 57 extend through the rear housing 56, the rear valve plate 83 and the other block half 44.

The front block half 43 has a central bore 43*a* and the rear block half 44 has a central bore 44*a*. The cylinder block has a swash-plate chamber 66, and suction inlets 49 and 50 which communicate with the swash-plate chamber 66. The cylinder block also has a plurality of working bores 51 and 52 extending in pairs in line parallel to each other around the central axial bores 43*a* and 44*a* at circumferentially equidistant pitches.

A swash-plate 48 is accommodated in the swash-plate chamber 11. A hollow drive shaft 45 is inserted in the central bores 43*a* and 44*a* of the cylinder block to fixedly support the swash-plate 48. A plurality of double headed pistons 53 are inserted in the respective pairs of working bores 51 and 52 for forming compression chambers Pa and Pb in each of the working bores 51 and 52. Each of the pistons 53 is engaged with the swash-plate 48 via shoes 16 and 17 to reciprocally move each of the pistons 53.

A discharge chamber 58 is formed between the front housing 54 and the front valve plate 82, and a discharge chamber 59 is formed between the rear housing 56 and the rear valve plate 83. The hollow drive shaft 45 includes a discharge passage 80 and radial holes 81 to interconnect the front and rear discharge chambers 58 and 59.

The valve plates 82 and 83 have central boss portions 84 and 85 having central holes 84*a* and 85*a* and projecting in the discharge chambers 58 and 59, respectively, and discharge ports 82*a* and 83*a* arranged in correspondence with the working bores 51 and 52. Flapper type discharge valves 75 and 76 are arranged in the discharge ports 82*a* and 83*a*, respectively, to allow the refrigerating gas to flow in one direction from the compression chamber Pa or Pb to the discharge chamber 58 or 59. A retainer 77 or 78 is provided over the discharge valve 31 or 32. The front housing 54 has a discharge outlet 60, and a lip seal 61 is arranged between the drive shaft 45 and the front housing 54 to prevent a leakage therebetween.

In this embodiment, the cylinder blocks 43 and 44 have annular or cylindrical locating projections 43*b* and 44*b* around the drive shaft 45, in the form of cylindrical outer surfaces. Each of the locating projections 43*b* and 44*b* fits in the central bore 84*a* and 85*a* of the boss portions 84 and 85 of the valve plates 82 and 83, respectively. The central bores 84*a* and 85*a* thus act as locating holes. The center of the cylindrical outer surfaces of the locating projections 43*b* and 44*b* lie on the center $L_1$ of the working bore arranging circle $C_1$.

Tapered roller bearings 46 and 47 are arranged in the central holes 84*a* and 85*a* of the boss portions 84 and 85 of the valve plates 82 and 83, respectively, to support the drive shaft 45. Each of the tapered roller bearings comprises an outer ring, an inner ring, and a plurality of rollers arranged between the outer and inner rings in a cone. The inner rings of the tapered roller bearings 46 and 47 are axially received by the shoulders of the drive shaft 45, respectively.

In this embodiment, suction chambers 62 and 63 are formed in each piston 53, the suction chambers 62 and 63 having inlets 64 and 65 to the swash-plate chamber 66, respectively. The refrigerating gas can flow from the swash-plate chamber 66 into the suction chambers 62 and 63 via the inlets 64 and 65, respectively. Each piston 53 also has suction ports 67 and 73 leading from the suction chambers 62 and 63 to the compression chambers Pa and Pb, respectively. Float type suction valves 68 and 74 are arranged on the either end of the piston 53. The suction valve 68 comprises a valve seat 69 fixed to the end wall of the piston 53 and having apertures 72, a floating disk valve 70 movably arranged in the valve seat 69, and a circlip type retainer 71 to retain the disk valve 70 within the valve seat 69. The disk valve 70 lifts and opens the apertures 72 in the suction stroke, and descends and closes the apertures 72 in the compression stroke. The rear suction valve 74 is similarly arranged to the front suction valve 68.

The operation of this embodiment is similar to that of the previous embodiment.

Also, the tapered roller bearings 46 and 47 supporting both the radial load and the thrust load to the drive shaft 45 are supported in the central locating holes 84*a* and 85*a* of the valve plates 82 and 83. The central locating holes 84*a* and 85*a* are fit over the locating projections 43*b* and 44*b* of the cylinder block 43 and 44. Accordingly, the central axis $L_0$ of the drive shaft 45 lies on the center $L_1$ of the working bore arranging circle $C_1$, if the center of the circle of the outer cylindrical surface of the locating projections 43*b* and 44*b* coincides with the center $L_1$ of the working bore arranging circle $C_1$. It is easy to place the center of the circle of the outer cylindrical surface of the locating projections 43*b* and 44*b* on the center $L_1$ of the working bore arranging circle $C_1$, and it is possible to exactly place the central axis $L_0$ on the center $L_1$, without an inclination or a parallel shift of the drive shaft 45 relative to the center $L_1$. It is thus possible to prevent the occurrence of noise and oscillation and the reduction of the compression efficiency.

Also, by arranging the suction chambers 62 and 63 in the pistons 45 to introduce the refrigerating gas from the swash-plate chamber 66 into the compression chambers Pa and Pb, it is possible to avoid using the suction chambers in the prior art which are arranged in the front and rear housings. Also, the provision of the discharge passage 80 arranged in the hollow drive shaft 45 makes it unnecessary to use a space in the cylinder block. Therefore, according to the present invention, it is possible to reduce the radius of the working bore arranging circle and thus to reduce the size and weight of the compressor. In this embodiment, the rotary valves 27 and 28 are eliminated and it is possible further to reduce the radius of the working bore arranging circle and thus to reduce the size of the compressor.

We claim:

1. A swash-plate type compressor comprising:

a cylinder block (1, 2) having opposite ends, a central axial (1*a*, 2*a*) bore, a plurality of working bores (13, 14) extending parallel to each other around the central bore, and a swash-plate chamber (11) intersecting the central bore and the working bores, a gas to be compressed being introduced into the swash-plate (3, 4) chamber;

first and second valve plates attached to respective opposite ends of the cylinder block, each of the valve plates having a central hole (3*a*, 4*a*) and discharge valves (31, 32) arranged around the central hole in correspondence with the working bores;

first and second housing (18, 19) attached to respective opposite ends of the cylinder block over the valve plates to form discharge chambers between the housings and the valve plates, respectively;

a drive shaft (7) inserted in the central axial bore of the cylinder block;

first and second tapered roller bearings (8, 9) secured in the central holes of the valve plates, respectively, to support the drive shaft;

annular locating projection means (3*b*, 4*b*) arranged on one of the cylinder block and the valve plates around the drive shaft;

locating hole means (1*a*, 2*a*) arranged in the other of the cylinder block and the valve plates to fit over the annular locating projection means;

a swash-plate (10) accommodated in the swash-plate chamber and fixed to the drive shaft for rotation therewith;

a plurality of double headed pistons (15) inserted in the respective working bores and reciprocally moved by the swash-plate for forming compression chambers (Pa, Pb) on either side of each of the double headed pistons, the compression chambers on one side of the double headed pistons communicating with one of the discharge chambers via the discharge valves; and a suction passage (1*b*, 2*b*) extending from the swash-plate chamber to each of the compression chambers between the first and second valve plates.

2. A swash-plate type compressor according to claim 1, wherein said annular locating projection means comprises a first cylindrical locating projection integrally formed with the first valve plate and a second cylindrical locating projection integrally formed with the second valve plate, and said locating hole means comprises a first cylindrical locating hole formed in the cylinder block at one side thereof to fit over the first cylindrical locating projection and a second cylindrical locating hole formed in the cylinder block at the other side thereof to fit over the second cylindrical locating projection.

3. A swash-plate type compressor according to claim 1, wherein said annular locating projection means comprises a first cylindrical locating projection integrally formed with the cylinder block at one side thereof and a second cylindrical locating projection integrally formed with the cylinder block at the other side thereof, and said locating hole means comprises a first cylindrical locating hole formed in the first valve plate to fit over the first cylindrical locating projection and a second cylindrical locating hole formed in the second valve plate to fit over the second cylindrical locating projection, the first and second cylindrical locating holes comprising a part of said central axial bore of the cylinder block.

4. A swash-plate type compressor according to claim 1, wherein each of said tapered roller bearings comprises an outer ring, an inner ring and a plurality of rollers between the outer and inner rings, and wherein the drive shaft has first and second shoulders to axially receive the inner rings of the tapered roller bearings, respectively, the outer rings of the tapered roller bearings being axially .received by the first and second housings respectively.

5. A swash-plate type compressor according to claim 4, wherein at least one of the outer rings of the tapered roller bearings is axially received by the corresponding housings via a spring.

6. A swash-plate type compressor according to claim 5, wherein said spring comprises a dish-shaped spring.

7. A swash-plate type compressor according to claim 1, wherein each of said first and second valve plates has one of the annular locating projection means and the annular locating hole means, and a bearing housing having a bearing surface to receive the tapered, roller bearing.

8. A swash-plate type compressor according to claim 1, wherein each of said first and second valve plates has one of the annular locating projection means and the annular locating hole means, and a boss portion having a bearing surface to receive the tapered roller bearing.

9. A swash-plate type compressor according to claim 1, wherein said suction passage comprises a suction port radially arranged in the cylinder block between the central bore and one of the working bores, and a rotary valve secured to the drive shaft for rotation therewith to selectively open or close the suction port.

10. A swash-plate type compressor according to claim 2, wherein the central bore of the cylinder block has an inner cylindrical surface having an inner diameter larger than an outer diameter of the drive shaft, and the rotary valve comprises a cylindrical valve body arranged between the drive shaft and the inner cylindrical surface of the central bore, the valve body having a valve port selectively communicable with the working bores.

11. A swash-plate type compressor according to claim 1, wherein said suction passage comprises a suction port arranged in each of the double headed pistons, and a suction valve to selectively open or close the suction port.

12. A swash-plate type compressor according to claim 1, wherein said drive shaft is hollow and a discharge passage is arranged in the drive shaft to interconnect the discharge chambers.

* * * * *